United States Patent [19]

Mederer

[11] Patent Number: 4,957,069

[45] Date of Patent: Sep. 18, 1990

[54] DRIVING OR WORKING ENGINE, IN PARTICULAR AN INTERNAL COMBUSTION ENGINE

[76] Inventor: Gerhard Mederer, Kellerstrasse 7, D-8501 Allersberg, Fed. Rep. of Germany

[21] Appl. No.: 299,357

[22] PCT Filed: May 3, 1988

[86] PCT No.: PCT/EP88/00367

§ 371 Date: Jan. 5, 1989

§ 102(e) Date: Jan. 5, 1989

[87] PCT Pub. No.: WO88/08922

PCT Pub. Date: Nov. 17, 1988

[30] Foreign Application Priority Data

May 8, 1987 [DE] Fed. Rep. of Germany ..... 3715391
Aug. 17, 1987 [DE] Fed. Rep. of Germany ..... 87111871

[51] Int. Cl.[5] ..... F02B 75/32

[52] U.S. Cl. ..... 123/48 B; 123/78 E; 123/177 A B

[58] Field of Search ..... 123/197 R, 197 AB, 197 AC, 123/48 R, 48 B, 78 R, 78 E, 78 F

[56] References Cited

U.S. PATENT DOCUMENTS

| | | | |
|---|---|---|---|
| 1,566,720 | 12/1925 | Andereau | 123/197 A C |
| 2,314,789 | 3/1943 | Jacobsen | 123/197 A C |
| 3,633,429 | 1/1972 | Olson | 123/197 A B |
| 3,693,463 | 9/1972 | Garman | 123/197 A B |
| 4,437,438 | 3/1984 | Mederer | 123/197 A B |
| 4,538,557 | 9/1985 | Klewer et al. | 123/197 A C |

*Primary Examiner*—David A. Okonsky
*Attorney, Agent, or Firm*—Collard, Roe & Galgano

[57] ABSTRACT

A driving or working engine, in particular an internal combustion engine, having at least one cylinder and a piston which moves axially in the latter and is connected to the crankshaft by an upper section of the connecting rod and a lower section of the connecting rod connected to the said upper section by a hinge. The two sections of the connecting rod are supported on an adjustable axle integral with the engine housing by a common hinged pivoting lever. In order to increase output and permit adaptation to different fuels, the end of the upper section of the connecting rod (5, 30) facing the piston (2) has an axial prolengation (27) which passes through the common hinge (9, 33) of the two sections of the connecting rod (5, 10 and 30, 35), and the end (14'', 36, 36') of the pivoting lever (14, 39) facing the two said sections of the connecting rod (5, 10 and 30, 35) engages in an articulated manner with the prologation (27).

11 Claims, 3 Drawing Sheets

Figure 1:
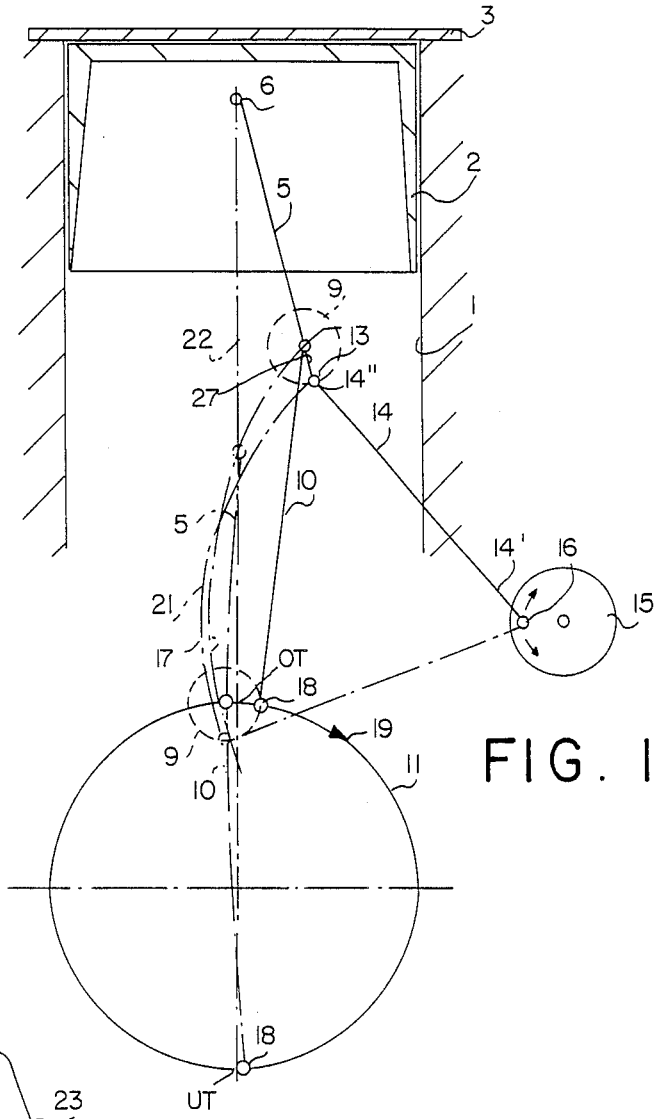

FIG. 6
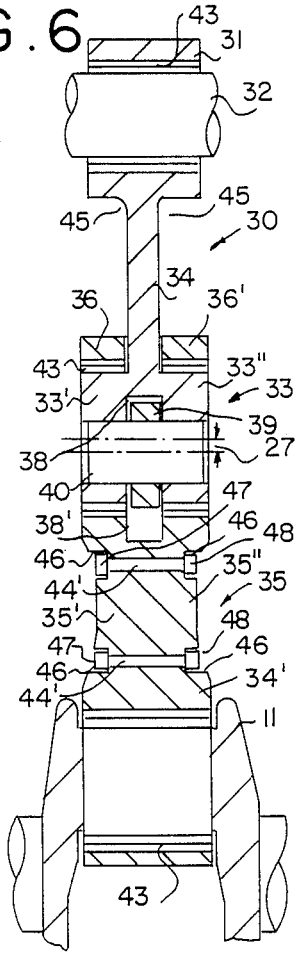
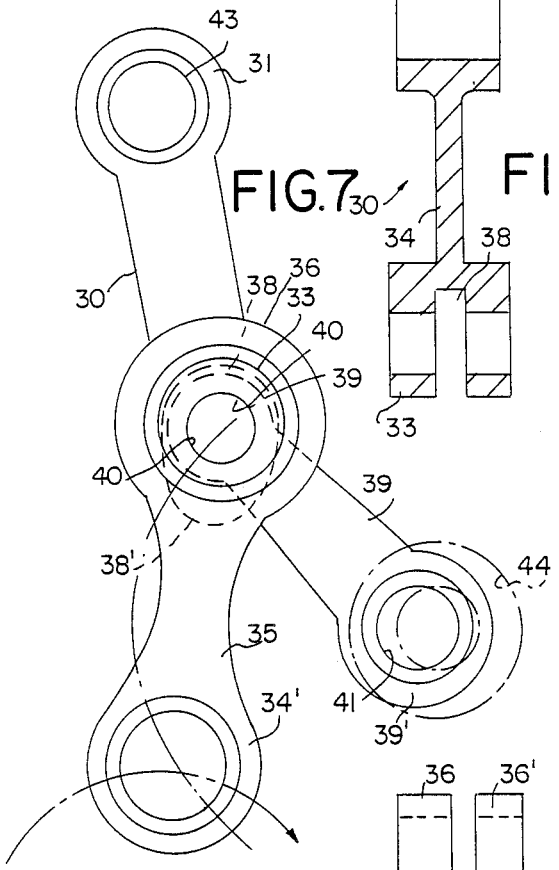
FIG. 7
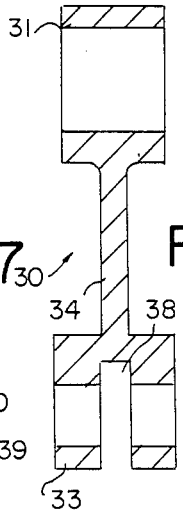
FIG. 8
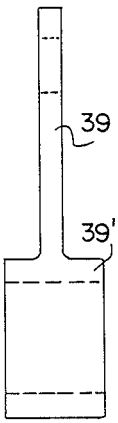
FIG. 10
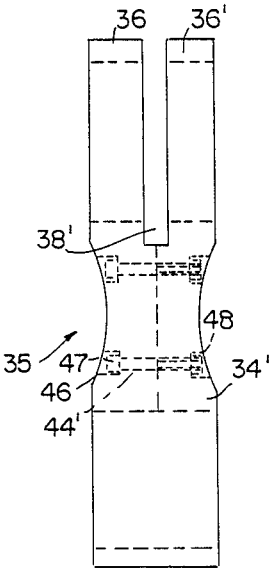
FIG. 9

DRIVING OR WORKING ENGINE, IN PARTICULAR AN INTERNAL COMBUSTION ENGINE

The invention concerns a driving or working engine, in particular an internal combustion engine, having at least one cylinder and a piston which moves axially in the latter and is connected to the crankshaft by an upper section of the connecting rod and a lower section of the connecting rod connected to the said upper section by a hinge. The two sections of the connecting rod are supported on an adjustable axle integral with the engine housing by a common hinged pivoting level which is connected to the housing. An internal combustion engine has been described U.S. Pat. No. 4,437,438 in which the piston and the crankshaft are connected to each other by two connecting rod sections that are joined in an articulated manner. In addtion, this internal combustion engine makes use of a pivoting lever connected to a common hinge of the two connecting rod sections, which is supported at its other end by an adjustable cam. In this internal combustion engine, the kinematics of the two connecting rod sections with the pivoting lever already result in an extended duration of the piston at its top dead center and thus in an improved torque characteristic.

In is the objective of the invention to permit increased performance and adaptation to different fuels in internal combustion engines of the type mentioned above.

According to the invention this objective is achieved as follows: At the end facing away from the piston, the upper section of the connecting rod has an axial extension beyond the common hinge of the two connecting rod sections, and the end of the pivoting lever which faces the connecting rod sections is connected to the extension in an articulated manner. It is advantageous to give the supporting axle for the pivoting lever in the engine housing an eccentric shape and to make it adjustable radially, or radially and axially.

In this manner, the common hinge of the two connecting rod sections and the hinge of the upper section of the connecting rod with the pivoting lever are situated on two separate paths of movement, which results in a reduced piston acceleration while piston displacement remains the same, and in the increased torque due to the formation of longer lever arms. The kinematics of the connection rod sections and the pivoting lever which have thus been achieved permit shifting the respectively most effective torque to the most effective postions of the crankshaft, which leads to a shortened ignition process, lower fuel consumption and thus to a smooth combustion process accompanied by quiet running of the internal combustion engine. Moreover, this is accompanied by a reduction in lateral piston pressure, reduced engine heat and reduced wear. It will be understood that the design of connecting rod sections and pivoting lever according to the invention can be appled equally well to gasoline and diesel engines, or to any other driving or working engine operating with a piston, such as compressors or pumps.

A particular advantageous design of the driving and working engine can be achieved when the length of the lower section of the connecting rod is approximately 1.3 times the length of the upper section of the connecting rod, the combined length of the two connection rod sections is approximately 3% greater than the distance between the connecting rod bearing of the upper section of the connecting rod at the piston and the circle described by the connecting rod bearing of the lower section of the connecting rod at the crankshaft with the piston at top dead center, and the pivoting lever has a length of approximately 1.2 times the length of the upper section of the connecting rod, the radial distance of the hinge point of the pivoting lever from the cylinder axis is approximately 1.0 times the length of the upper section of the connecting rod, and the base point of the projection of the hinge point on the cylinder axis has a distance from the crankshaft axis of approximately one-third of the distance of the connecting rod bearing of the upper section of the connecting rod at the piston from the crankshaft axis at top dead center of the piston. The relatively long duration of the piston at its top dead center which is assured in this manner permits an optimal match between the combustion of the fuel and the motion of the piston, with combustion beginning at top dead center. Such a shift of the injection interval in the direction of a later point in time is possible because the piston remains longer in its top dead center region. This also results in reduced retardation of ignition, leading to lowered temperatures and pressure loads on the engine. In addition, tests have shown that a substantial fuel saving can be achieved while performance remains the same. Finally, it is also possible to make use of the most diverse fuels, since piston speed is variable and can be adapted to the respective fuel. Tests have proved that diesel engines having kinematics as described can also be operated on gasoline without modifications and without any decrease in performance. Moreover, due to the lower piston loading it is possible to use pistons which are more lightly built or are less in weight.

The design of the driving or working engine further provides for the upper section of the connecting rod to be fork-shaped, with a round bearing plate rigidly attached to it, to which are hinged the ends of the lower section of the connecting rod and of the pivoting lever that face away from the crankshaft and the supporting axle, respectively. Preferably, the fork ends of the upper section of the connecting rod will be fitted with recesses over which the bearing plate extends, with the circumferent surface of the bearing plate centrically supporting the lower section of the connecting rod and the portion of the bearing plate situated in the area of the recesses being eccentrically connected to the pivoting lever in an articulated manner. This serves to achieve, in a simple manner, the required axial extension of the upper section of the connecting rod and a narrow design for the connecting rod formed by the connecting rod sections, so that the connecting rod sections and the pivoting lever can also be accommodated in multi-cylinder engines in a space-saving manner. Further, the design provides for placing the supporting axle either in the engine housing or outside of it. In the latteer design, the pivoting lever passes through an opening in the engine housing wall in order to be connected to the supporting axle. To improve the counterbalancing of the driving and working engine, the preferred design provides for the upper section of the connecting rod to carry a strip-shape bridge rigidly and symmetrically attached in the longitudinal center plane, having a cylinder section placed at the end facing away from the piston, whose partial sections extending over the brige serve as bearings for ring portions of the lower section of the connecting rod, and that recesses are provided in the upper section of the connecting rod in the plane of the bridge and in the lower section of the connecting rod between the ring portions, through which passes a pin placed eccentrically in the cylinder section, to which the pivoting lever is attached with one end. Apart from the weight reduction achieved in this manner, especially for the upper section of the connecting rod, with a pin and pivoting lever of about one-third the weight of the design described previously, the bridge will be able to carry and equalize a certain amount of bending stress. Moreover, a narrower design of the connecting rod is achieved, so that the counterweights of the crankshaft, which can be lighter in any case, can also be of a space-saving design. In addition, the design provides for building up the lower section of the connecting rod from half-sections, which are joined to each other by means of fasteners, such as screws over part of the length, each of which carry one of the ring portions at the ends facing the piston, with the common width of the two halves of the connecting rod section being the same as, or less than, the axial length of the cylinder section. Splitting the lower section of the connecting rod makes it possible to assemble the connecting rod sections and the pivoting lever. It has proved to be especially advantageous to support the two ring portions of the lower section of the connecting rod with needle bearings on the parts of the upper section of the connecting rod instead of the friction bearings used hitherto. To eliminate the need for fastening elements to prevent undesirable axial movements of the pin, the latteer should be press-fitted to the pivoting lever and is held within the cylinder section without lateral play. Finally, it is possible to make the effective length of the pivoting lever variable, by attaching the pivoting lever with its end facing away from the cylinder section to an axle or shaft located eccentrically on a rotatable disk.

Figure 4:
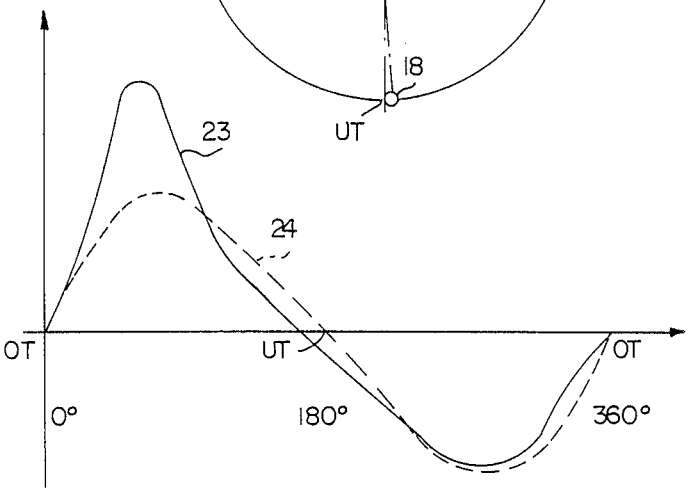
Figure 2:
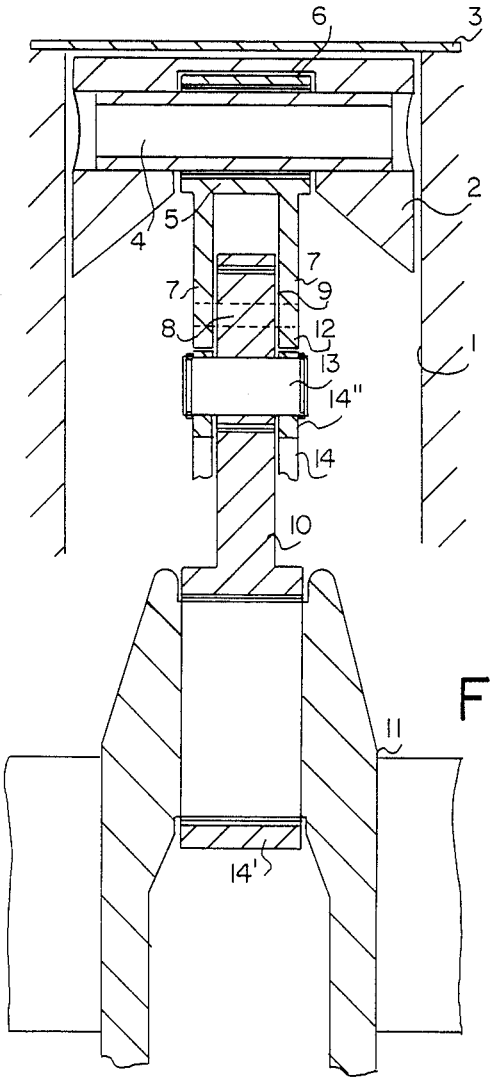
Figure 3:
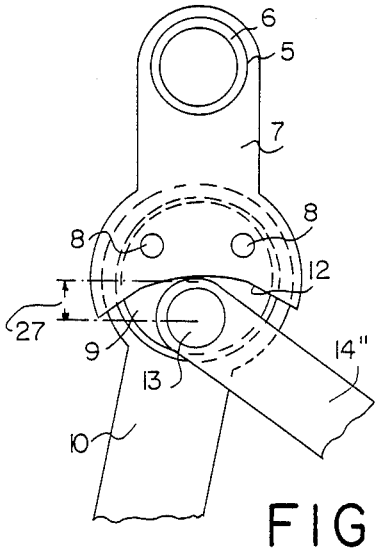
Figure 5:
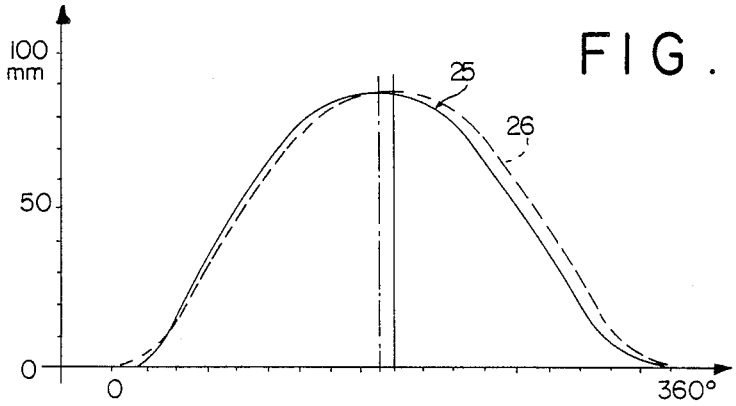

The drawing illustrates the invention by means of an implemented example. It shows:

FIG. 1 a schematic sectionsal view of driving or working engine,

FIG. 2 a sectional view of a driving or working engine,

FIG. 3 side views of portions of the connecting rod sections and of the pivoting lever, FIGS. 4 and 5 various graphs, FIG. 6 sectional views of a different design of a connecting rod and pivoting lever, FIG. 7 a side view of a connecting rod and pivoting lever from FIG. 6, FIG. 8 a sectional view of an upper section of the connecting rod, FIG. 9 a front view of a lower section of the connecting rod, and FIG. 10 a front view of a pivoting lever.

In the Figures, 1 indicates a cylinder, e.g. of an internal combustion engine, which houses a movable piston 2. In the example shown, the cylinder 1 is closed at its upper end by a plate-shaped cylinder head 3. For the sake of clarity, the devices for supplying fuel and air or the fuel-air mixture, and for removing the combustion gases are not shown.

The piston 2 holds a wrist pin 4 to which an upper connecting rod section 5 is hinged with its upper bearing 6. The connecting rod section 5 is fork-shaped, and the arms 7 of the connecting rod section carry, by means of bolts 8, a bearing plate 9 in the area of their free ends, to which the upper end of a lower section of the connecting rod 10 is hinged, which in turn is joined with its lower bearing 18 to a crankshaft 11. The arms 7 have recesses 12 over which the bearing plate 9 extends. A pivoting lever 14 is joined to the bearing plate 9 with its end 14" by means of a shaft 13, and is supported at its other end 14' in an articulated manner by a bearing 16 which is eccentrically situated on a supporting axle 15. As shown particularly in FIGS. 1 and 3, the pivotal point for the pivoting lever 14 is extended at the upper section of the connecting rod beyond the common pivot of the connecting rod sections 5 and 10 by means of the extension 27. Rotating the supporting axle 15 will adjust the position of the bearing 16, and thus the effective length of the pivoting lever 14.

In FIG. 1 the piston 2 is at top dead center. When the piston 2 moves downward, the connecting rod bearing 6 at the piston moves along the cylinder axis 22, and the bearing plate 9 on a circular path 17. The shaft 13 moves along another circular path 21. At the same time, the crankshaft 11, and the bearing 18 on the crankshaft, turn in the direction of the arrow 19. The position changes of the connection rod sections 5 and 10 and of the pivoting level 14 at bottom dead center of the piston 2 correspond to the dashed lines. The corresponding position of the bearing 18 on the crankshaft is indicated by the letteers UT. It can be seen that, when the piston 2 moves downward from top dead center, the path of motion 17 of the bearing plate 9 approaches the cylinder axis 22 and intersects it as the piston 2 continues to move down. The result is that as the piston 2 moves down from top dead center, it initial movement away from top dead center is slow, while the connecting rod bearing 18 located on the crankshaft already has passed through a relatively large crankshaft angle and the lower connecting rod section 10 reaches a position in which it is capable of transmitting a large amount of torque. These relationships are illustrated by the graphs of FIGS. 4 and 5. The solid line 23 in FIG. 4 shows the torque curve for an internal combustion engine designed in accordance with the invention. The abscissa shows the 360 degrees of a crankshaft rotation, the ordinate shows the torque value determined for constant piston force. The dashed line 24 represents the torque curve for a conventional engine by comparison. The graph shows that for line 23, maximum torque can be achieved at a crankshaft rotation of about 45 degrees, and at a crankshaft rotation of about 65 degrees for the dashed line. Applying these values to FIG. 5 which shows piston displacement during one crankshaft rotation, with the solid line 25 representing the internal combustion engine according to the invention andd the dashed line 26 a conventional engine by way of comparison, it can be seen that for the comparison engine (line 26) the piston 2 leaves its top dead center position sooner and returns back to it later, and thus remains at its top dead center position for a much shorter time than the piston 2 of the design according to the invention (line 25).

Measurements taken when operating the engine using the kinematics of connecting rod and pivoting lever as claimed have shown that it is possible to achieve a fuel consumption reduced by 40%, or a correspondingly higher performance. Moreover, the exhaust gas contains fewer harmful components. The nitrous oxide content of the exhaust gas is reduced by about 55%, the soot content by about 75%. As has been pointed out, peak pressures are reduced, and due to the reduced amount of ignition retardation, ignition is smoother, which is to say, nearly equivalent to combustion at constant volume. This results in smoother running of the internal combustion engine. The internal combustion engine can be operated with diesel fuel, gasoline, or other fuels, including low-energy fuels such as vegetable oils. In addition the engine stays cooler overall, making possible a cooling system of reduced size. Tests have shown that the engine may even be operated without any water cooling. The reduced amount of heat it produces should be able to be handled by a increased quantity of engine oil, with an oil cooler added if need be. This also has advantages with respect to antifreeze requirements when operating in winter.

In the implemented example of FIGS. 6 through 10, the upper section of the connecting rod 30 is hinged to a wrist pin 32 by means of its upper bearing 31 and is fitted with a cylinder section 33 at its end facing away from the piston. The bearing 31 and the cylinder section 33 are joined by a bridge 34 that extends symmetrically along the longitudinal central axis of the upper section of the connecting rod. The partial section 33' and 33" of the cylinder section 33 carries ring portions 36 and 36' of a lower section of the connection rod 35, which is connected to the crankshaft 11 by means of its bearing 34. The bearing 31, the partial section 33' and 33" and the bearing 34 are fitted with needle bearings 43. Recesses 38 and 38' are provided in the cylinder section 33 and between the partial sections 33' and 33" through which a pivoting lever 39 passes, which holds a press-fitted pin 40 that is rotatably attached to the partial sections 33' and 33" and whose end 39' is supported as a support point on the engine housing, e.g. by a pivot 41 eccentrically located on a rotatable disk 44. In order to form the extension 27 of the upper section of the connecting rod 30, the design of FIGS. 6 through 10 has the central axis of the pin 40 offset relative to the central axis of the cylinder section 33. The design of the connecting rod sections 30 and 35 results in a particularly narrow connecting rod of reduced weight, making possible good counterbalancing and an advantageous attachment of the crankshaft 11 with respect to the connecting rod. Finally, the bridge 34 of the upper section of the connecting rod yields free spaces 45 through which portions of the crankshaft, such as counterbalancing weights, can be passed. Moreover, the pivoting lever 39 is joined to the connecting rod sections 30 and 35 in the area of the longitudinal central plane, thus preventing a tilting torque from occurring at the pivoting lever 39 and the connecting rod section 30, 35. It will be understood that a rotating shaft could also be used as a supporting element for the pivoting lever 39 instead of the pivot 41 that supports the pivoting lever 39 in this design.

In the example, the lower section of the connecting rod 35 is formed out of half-rod 35', 35" that are joined by means of fasteners, such as screws 44'. In order to avoid protruding ends, recesses 46 are provided for receiving the screw heat 47 and nuts 48 of the fastening elements.

I claim:

1. An engine having a housing comprising:

at least one cylinder;

a piston for moving axially within said cylinder;

a crankshaft;

a multi-piece connecting rod having an upper section and a lower section;

said piston being connected to the crankshaft by the upper section of said connecting rod;

a common hinge having a central axis for connecting the lower section of the connecting rod to said upper section;

an adjustable pivot for connecting said upper and lower connecting rod sections with the engine housing through a pivoting lever attached to said hinge;

said upper section having a lower portion, said lower portion of the upper section of the connecting rod carrying an axial extension;

said axial extension extending axially beyond the common hinge central axis towards said lower section;

said pivoting lever having a first end and a second end, said first end joined to said common hinge in an articulated manner, and said second end being supported by an eccentric pivot; and a plate having said eccentric pivot eccentrically placed thereon and said plate rigidly and adjustably attached to the engine housing.

2. The engine according to claim 1, wherein said plate is radially and axially adjustable.

3. The engine according to claim 1, wherein the lower section of the connecting rod has a length approximately 1.3 times the length of the upper section of the connecting rod;

a connecting rod bearing for the upper section of the connecting rod;

a connecting rod bearing for the lower section of the connecting rod;

the combined length of the connecting rod upper and lower sections being approximately 3% greater than the distance between the connecting rod bearing of the upper section of the connecting rod at the piston and the circle described by the connecting rod bearing of the lower section of the connecting rod at the crankshaft with the piston at top dead center;

said pivoting lever having a length approximately 1.2 times the length of the upper section of the connecting rod;

the radial distance of the hinge point of the pivoting lever from the cylinder axis is approximately 1.0 times the length of the upper section of the connecting rod; and the base point of the projection of the bearing on the cylinder axis having a distance from the crankshaft axis of approximately one-third of the distance of the connecting rod bearing of the upper section of the connecting rod from the crankshaft axis at top dead center of the piston.

4. An engine according to claim 1, wherein said upper section of the connecting rod has two arms and is fork-shaped; and a round bearing plate rigidly attached to said upper section; and the lower section of the connecting rod hinged concentrically to said round bearing plate and the pivoting lever hinged eccentrically to said round bearing plate.

5. An engine according to claim 4, wherein the arms of the fork-shaped connecting rod section are fitted with recesses;

said bearing plate extending over said recesses;

the circumference surface of the bearing plate supporting the lower section of the connecting rod; and the pivoting lever being connected to the bearing plate in the area of the recesses in an articulated manner.

6. An engine according to claim 1, wherein said plate is situated in the interior of the engine housing.

7. An engine according to claim 1, wherein said plate is situated outside of the engine housing.

8. An engine according to claim 1, further comprising a strip-shape bridge rigidly attached to the upper section of the connecting rod;

a cylinder section attached to said bridge and placed at the end of said bridge facing away from the piston;

said cylinder section having partial sections extending over the bridge and serving as bearings for ring portions of the lower section of the connecting rod;

recesses being provided in the cylinder section in the plane of the bridge and in the lower section of the connecting rod between the ring portions;

a pin passing through said ring portions transversely and which is placed eccentrically in the cylinder section at the distance from the axis of the cylinder section;

said pivoting lever having one end thereof attached to said cylinder section by said pin.

9. An engine according to claim 8, further comprising half-sections on the lower section of the connecting rod over part of the length of said connecting rod;

fastener means for joining together said half-sections; each of said half-sections carrying one of the ring portions at the ends facing the piston; and the common width of the two connecting rod sections is the same as, or less than, the axial length of the cylinder section.

10. An engine according to claim 9, further comprising needle bearings for supporting the two ring portions of the lower section of the connecting rod; said needle bearings being located on the parts of the upper section of the connecting rod.

11. An engine according to claim 10, wherein the pin is press-fitted into the pivoting lever, and is held in the cylinder section without play by said pivoting lever.

* * * * *